US011773338B1

(12) United States Patent
Cao et al.

(10) Patent No.: US 11,773,338 B1
(45) Date of Patent: Oct. 3, 2023

(54) METHODS OF PROCESSING WHOLE CRUDE OILS THAT INCLUDE SULFUR

(71) Applicant: Saudi Arabian Oil Company, Dhahran (SA)

(72) Inventors: Sufeng Cao, Cambridge, MA (US); Douglas P. Theberge, Cambridge, MA (US); Brian Hanna, Cambridge, MA (US); Michael J. Forte, Cambridge, MA (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/052,447

(22) Filed: Nov. 3, 2022

(51) Int. Cl.
*C10G 55/02* (2006.01)

(52) U.S. Cl.
CPC ..... *C10G 55/02* (2013.01); *C10G 2300/1033* (2013.01); *C10G 2300/202* (2013.01); *C10G 2300/706* (2013.01); *C10G 2300/708* (2013.01)

(58) Field of Classification Search
CPC ..... C10G 55/02; C10G 2300/1033; C10G 2300/202; C10G 2300/706; C10G 2300/708
See application file for complete search history.

(56) References Cited

U.S. PATENT DOCUMENTS 5,059,302 A * 10/1991 Weinberg ..... C10G 11/18 208/113
6,184,176 B1 2/2001 Khare
6,495,029 B1 12/2002 Schorfheide et al.
7,201,839 B2 4/2007 Turaga et al.
8,142,646 B2 3/2012 Choi et al.
2003/0211017 A1* 11/2003 Pankaj ..... C10J 3/54 422/139
2004/0118751 A1 6/2004 Wagner et al.
2009/0120842 A1* 5/2009 Koseoglu ..... C10G 7/06 202/153

OTHER PUBLICATIONS

Alabdullah et al., "One-step conversion of crude oil to light olefins using a multi-zone reactor", Nature Catalysis, vol. 4, pp. 233-241, Mar. 2021.

(Continued)

*Primary Examiner* — Randy Boyer
*Assistant Examiner* — Juan C Valencia
(74) *Attorney, Agent, or Firm* — DINSMORE & SHOHL LLP

(57) ABSTRACT

According to embodiments described herein, a method of processing a whole crude oil feed stream may include passing a whole crude oil feed stream into a fluid catalytic cracking unit and contacting the whole crude oil feed stream with an adsorbent material and a cracking catalyst. The adsorbent material may adsorb at least a portion of the sulfur of the whole crude oil feed stream and at least a portion of the whole crude oil feed stream may be catalytically cracked to produce coke disposed on the cracking catalyst. The method may further include passing the adsorbent material and the cracking catalyst to a regenerator, wherein the adsorbent material and the cracking catalyst contact an oxygen-containing gas at a temperature sufficient to remove at least a portion of the sulfur on the adsorbent material and combust at least a portion of the coke on the catalyst.

20 Claims, 1 Drawing Sheet

(56) References Cited

OTHER PUBLICATIONS

Babich et al., "Science and technology of novel processes for deep desulfurization of oil refinery streams: a review", Fuel, vol. 82, pp. 607-631, 2003.
Huang et al., "In situ XAS study on the mechanism of reactive adsorption desulfurization of oil product over Ni/ZnO", Applied Catalysis B: Environmental, vol. 106, pp. 26-38, 2011.
Ju et al., "Reactive Adsorption Desulfurization of Hydrotreated Diesel over a Ni/ZnO—Al2O3—SiO2 Adsorbent", Energy & Fuels, vol. 29, pp. 6057-6067, 2015.
Ju et al., "Reactive Adsorption Desulfurization of Fluidized Catalytically Cracked (FCC) Gasoline over a Ca-Doped Ni-ZnO/Al2O3-SiO2 Adsorbent", Energy & Fuels, vol. 30, pp. 6686-6697, 2016.

* cited by examiner

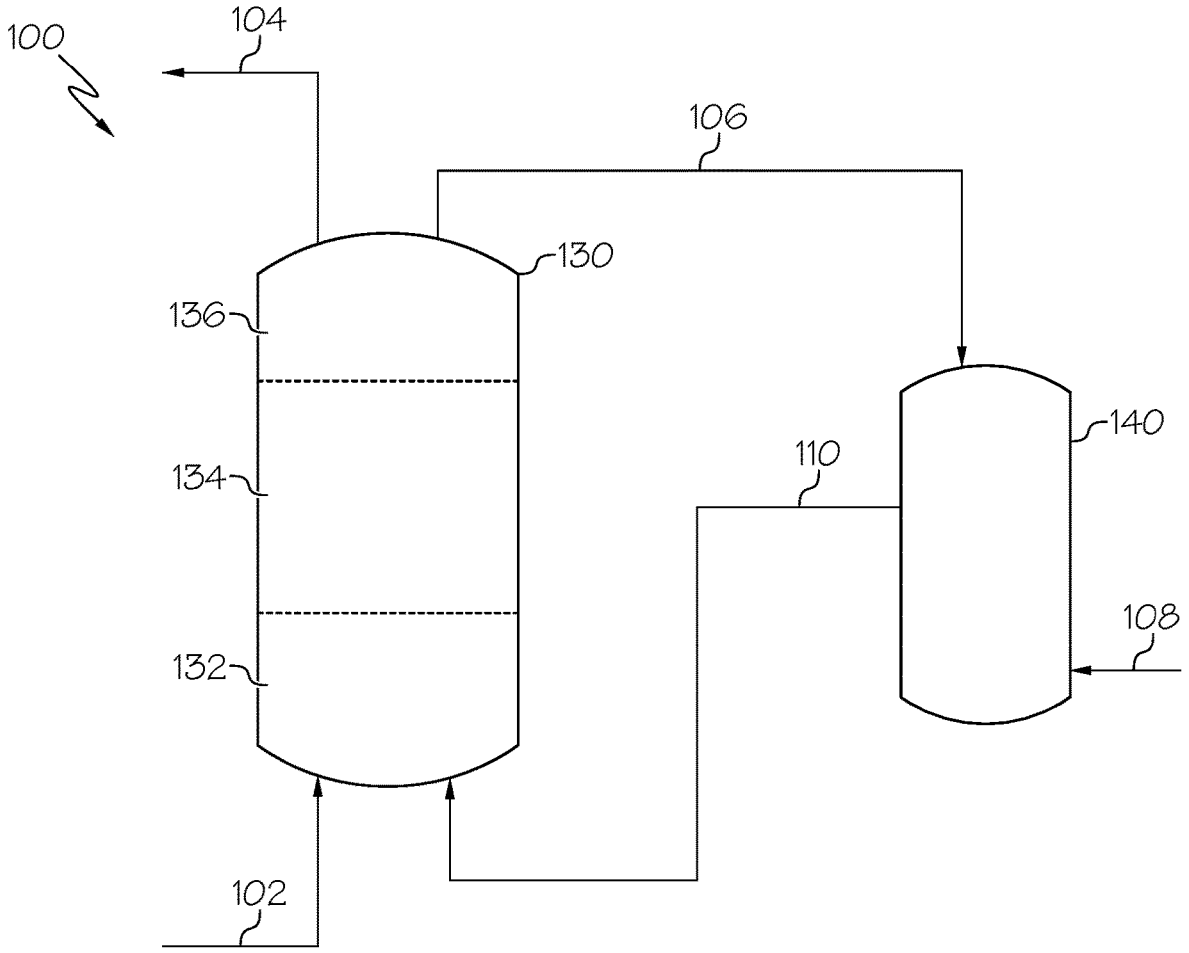
100
104
106
130
136
134
132
110
140
108
102

METHODS OF PROCESSING WHOLE CRUDE OILS THAT INCLUDE SULFUR

TECHNICAL FIELD

Embodiments of the present disclosure generally relate to chemical processing and, more specifically, to processes and systems utilizing fluid catalytic cracking of feed chemicals.

BACKGROUND

Ethylene, propene, butene, butadiene, and aromatic compounds such as benzene, toluene, and xylenes are basic intermediates for a large proportion of the petrochemical industry. They are usually obtained through the thermal cracking (or steam pyrolysis) of petroleum gases and distillates such as naphtha, kerosene, or even gas oil. These compounds are also produced through refinery fluidized catalytic cracking (FCC) processes where classical heavy feedstocks such as gas oils or residues are converted. Typical FCC feedstocks range from hydrocracked bottoms to heavy feed fractions such as vacuum gas oil and atmospheric residue; however, these feedstocks are limited. With these traditional feedstocks being limited, there is a market need for the chemical intermediates described above.

SUMMARY

According to embodiments described herein, whole crude oil (as opposed to downstream, refined petrochemical products) may be converted to products such as olefins and aromatics by fluid catalytic cracking. However, such whole crude feedstocks contain sulfur, which is undesirable in the product if not removed. Described herein is a method by which whole crude oil can be processed by cracking and sulfur reduction may occur simultaneously. In such embodiments described herein, an adsorbent material is utilized in an FCC process, where the adsorbent material is sometimes mixed with the cracking catalyst and is passed along with the cracking catalyst between the FCC unit and a regenerator. In the regenerator, sulfur content can be reduced on the adsorbent material such that the process is repeatable in a continuous fashion. In such embodiments, pre-processing to remove sulfur, such as by hydrotreating, is not required. For example, in some embodiments described herein, no external hydrogen needs to be introduced into the fluid catalytic cracking unit and no hydrogen treatment is needed for either the adsorbent material or the catalyst before the adsorbent material or the catalyst enters the FCC unit. Further, the spent adsorbent material and the spent catalyst are able to be sent to the same regenerator and be regenerated under the same regeneration conditions. Lastly, the adsorbent material and the catalyst are able to sufficiently remove sulfur and catalytically crack components in a stream comprising whole crude oil, where the whole crude oil does not need to be separated before entering the fluid catalytic cracking unit.

According to embodiments described herein, a method of processing a whole crude oil feed stream may include passing a whole crude oil feed stream into a fluid catalytic cracking unit and contacting the whole crude oil feed stream with an adsorbent material and a cracking catalyst in the fluid catalytic cracking unit. The cracking catalyst may include a zeolite. The whole crude oil feed stream may include sulfur. Further, when in the fluid catalytic cracking unit, the adsorbent material may adsorb at least a portion of the sulfur of the whole crude oil feed stream such that the content of sulfur on the adsorbent material increases. Also, at least a portion of the whole crude oil feed stream may be catalytically cracked to produce one or more products and coke disposed on the cracking catalyst. The method may further include passing the adsorbent material and the cracking catalyst comprising coke to a regenerator, where the adsorbent material and the cracking catalyst may contact an oxygen-containing gas at a regenerator temperature sufficient to remove at least a portion of the sulfur on the adsorbent material and combust at least a portion of the coke on the catalyst. The method may further include passing the adsorbent material and the cracking catalyst from the regenerator to the fluid catalytic cracking unit.

Additional features and advantages of the described embodiments will be set forth in the detailed description which follows, and in part will be readily apparent to those skilled in the art from that description or recognized by practicing the described embodiments, including the detailed description which follows, the claims, as well as the appended drawing.

BRIEF DESCRIPTION OF THE DRAWING

The following detailed description of specific embodiments of the present disclosure can be best understood when read in conjunction with the following drawing, where like structure is indicated with like reference numerals and in which:

FIG. 1 is a generalized schematic diagram of a hydrocarbon feed conversion system, according to one or more embodiments described in this disclosure.

For the purpose of describing the simplified schematic illustrations and descriptions of the relevant figures, the numerous valves, temperature sensors, electronic controllers and the like that may be employed and well known to those of ordinary skill in the art of certain chemical processing operations are not included. Further, accompanying components that are often included in typical chemical processing operations, such as air supplies, catalyst hoppers, and flue gas handling systems, are not depicted. Accompanying components that are in hydrocracking units, such as bleed streams, spent catalyst discharge subsystems, and catalyst replacement sub-systems are also not shown. It should be understood that these components are within the spirit and scope of the present embodiments disclosed. However, operational components, such as those described in the present disclosure, may be added to the embodiments described in this disclosure.

It should further be noted that arrows in the drawing refer to process streams. However, the arrows may equivalently refer to transfer lines which may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawing may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that according to the embodiments presented in the relevant figures, an arrow between two system components may signify that the stream is not processed between the two system components. In other embodiments, the stream signified by the arrow may have substantially the same composition throughout its transport between the two system components. Additionally, it should be understood that in one or more embodiments, an arrow may represent that at least 75 wt.%, at least 90 wt.%, at least 95 wt.%, at least 99 wt.%, at least 99.9 wt.%, or even 100 wt.% of the stream is transported between the system components. As such, in some embodiments, less than all of the streams signified by an arrow may be transported between the system components, such as if a slip stream is present.

It should be understood that two or more process streams are "mixed" or "combined" when two or more lines intersect in the schematic flow diagrams of the relevant figures. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor.

Reference will now be made in greater detail to various embodiments, some embodiments of which are illustrated in the accompanying drawing. Whenever possible, the same reference numerals will be used throughout the drawing to refer to the same or similar parts.

DETAILED DESCRIPTION

References will now be made in greater detail to various embodiments. Referring to FIG. 1, a hydrocarbon feed conversion system 100 is depicted wherein the methods presently disclosed may take place. According to one or more embodiments, the method of processing a whole crude oil feed stream 102 may comprise passing a whole crude oil feed stream 102 into a fluid catalytic cracking unit 130, where the whole crude oil feed stream 102 contacts an adsorbent material and a cracking catalyst while in the fluid catalytic cracking unit 130. As is described in detail herein, the adsorbent material and cracking catalyst may be cycled between the fluid catalytic cracking unit 130 and the regenerator 140.

As used throughout this disclosure, the term "fluid catalytic cracking unit" refers to a vessel or other like body in which one or more cracking chemical reactions occur to one or more reactants in the presence of one or more catalysts. Solids, such as catalysts, in the fluid catalytic cracking unit 130 generally operate with a fluidized flow regime. As used in this disclosure, "cracking" generally refers to a chemical reaction where carbon-carbon bonds are broken. For example, a molecule having carbon to carbon bonds is broken into more than one molecule by the breaking of one or more of the carbon to carbon bonds, or is converted from a compound which includes a alkyl or cyclic moiety, such as a alkane, cycloalkane, naphthalene, an aromatic or the like, to an olefinic compound and/or a compound which does not include a cyclic moiety or contains fewer cyclic moieties than prior to cracking. In addition, a fluid catalytic cracking unit 130 may contain multiple zones. For example, a fluid catalytic cracking unit 130 may contain a mixing zone where the one or more reactants may mix with any catalysts and/or absorbent materials present in the fluid catalytic cracking unit 130, a reaction and adsorption zone where the one or more reactants may react with the one or more catalysts and one or more adsorbent materials, and a separation zone where the one or more catalysts and one or more adsorbent materials may be separated from the remaining contents of the fluid catalytic cracking unit 130.

As used in this disclosure, the term "catalyst" refers to any substance that increases the rate of a specific chemical reaction. Catalysts described in this disclosure may be utilized to promote various reactions, such as, but not limited to, cracking (including aromatic cracking). The term "cracking catalyst" refers to catalysts that are operable to conduct the above-referenced cracking reactions, but are not limited to only conducting these types of reactions.

As used in this disclosure, the term "adsorbent material" refers to any composition that can adsorb at least a portion of an unwanted substance, such as sulfur, from a feed stream.

As used in this disclosure, the term "regenerator" refers to any suitable combustion unit, where combustion gas such as air or other oxygen-containing gas streams are passed into the combustion unit and flue gas is expelled. The combustion gases may include one or more of combustion air, oxygen, fuel gas, fuel oil, other components, or any combinations of these. In a regenerator, like regenerator 140, coke that may be deposited on a catalyst may at least partially oxidize (combust) in the presence of the combustion gases to form at least carbon dioxide and water. In some embodiments, the coke deposits on the catalyst may be fully oxidized in the regenerator 140. Other organic compounds, such as residual cracking reaction products, may also oxidize in the presence of the combustion gases in the regenerator 140. Other gases, such as carbon monoxide, for example, may be formed during coke oxidation in the regenerator 140. Oxidation of the coke deposits produces heat, which may be transferred to and retained by the regenerated catalyst when passed to other units.

As generally described herein, the cracking catalyst and adsorbent material may be present in a "spent" or "regenerated" state. The spent state is generally following exposure to the cracking reaction in the FCC unit 130, and the regenerated state is generally following regeneration in the regenerator 140. For example, stream 106 generally includes spent cracking catalyst and spent adsorbent material, while stream 110 generally includes regenerated cracking catalyst and regenerated adsorbent material.

As used in this disclosure, the term "spent catalyst" generally refers to catalyst that has been introduced to and passed through a cracking reaction zone to crack a hydrocarbon material, such as the whole crude oil feed stream, but has not been regenerated in the regenerator 140. Generally, spent catalyst has highly reduced activity due to, for example, coke deposited on the catalyst. The "spent catalyst" may have coke deposited on the catalyst and may include partially coked catalyst as well as fully coked catalysts. The amount of coke deposited on the "spent catalyst" may be greater than the amount of coke remaining on the regenerated catalyst following regeneration. As used in this disclosure, the term "regenerated catalyst" generally refers to catalyst that has been introduced to a cracking reaction zone and then regenerated in a regenerator, like regenerator 140, to heat the catalyst to a greater temperature, oxidize and remove at least a portion of the coke from the catalyst to restore at least a portion of the catalytic activity of the catalyst, or both.

As used in this disclosure, the term "spent adsorbent material" refers to the adsorbent material that has adsorbed at least a portion of the sulfur from a stream comprising sulfur. The spent adsorbent material may have a higher amount of adsorbed sulfur after contacting the whole crude oil feed stream 102 in the fluid catalytic cracking unit 130 than when the adsorbent material is first introduced into the fluid catalytic cracking unit 130. Generally, the spent adsorbent material will have a reduced activity of adsorbing sulfur due to more sites on the adsorbent material already bonding to sulfur. The amount of sulfur adsorbed onto the spent adsorbent material may be greater than the amount of sulfur adsorbed onto the adsorbent material following regeneration. As used in this disclosure, the term "regenerated adsorbent material" generally refers to adsorbent material that has been introduced to a cracking reaction zone and then regenerated in a regenerator, like regenerator 140, to remove adsorbed sulfur. Generally, the regenerated adsorbent material will have an increased activity of adsorbing sulfur due to more sites on the adsorbent material no longer bonding to sulfur.

It should further be understood that streams may be named for the components of the stream, and the component for which the stream is named may be the major component of the stream (such as comprising from 50 weight percent (wt. %), from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "propylene stream" passing from a first system component to a second system component should be understood to equivalently disclose "propylene" passing from a first system component to a second system component, and the like.

Referring again to FIG. 1, a hydrocarbon feed conversion system 100 is schematically depicted. The hydrocarbon feed conversion system 100 may include a fluid catalytic cracking unit 130 and a regenerator 140. The hydrocarbon feed conversion system 100 generally receives a whole crude oil feed stream 102 to produce at least a products stream 104.

In one or more embodiments, the hydrocarbon feed conversion system 100 includes a fluid catalyst cracking (FCC) unit 130 in which at least a portion of the whole crude oil feed stream 102 enters the FCC unit 130 and contacts a cracking catalyst and an adsorbent material at relatively high temperatures and pressures. When the whole crude oil feed stream 102 contacts the heated catalyst and is cracked to lighter products, carbonaceous deposits, commonly referred to as coke, form on the catalyst. The coke deposits formed on the catalyst may reduce the catalytic activity of the catalyst or deactivate the catalyst. Deactivation of the catalyst may result in the catalyst becoming catalytically ineffective. The spent catalyst having coke deposits may be separated from the cracking reaction products, stripped of removable hydrocarbons, and passed to a regenerator 140. Additionally, the whole crude oil feed stream 102 contacts the adsorbent material in the FCC unit 130, where the adsorbent material adsorbs at least a portion of the sulfur from the whole crude oil feed stream 102 such that the content of sulfur on the adsorbent material increases and the content of sulfur in the whole crude oil feed stream 102 decreases. The adsorbent material may be separated from the other contents present in the FCC unit 130 and be sent to the regenerator 140. In some embodiments, the spent catalyst having coke deposits and the adsorbent material that has adsorbed at least a portion of sulfur from the whole crude oil feed stream 102 may be sent to the regenerator 140 in one stream and/or be processed in the regenerator 140 at the same time and at the same conditions. The regenerator 140 may operate such that coke is burned from the catalyst in the presence of an oxygen-containing gas to produce a regenerated catalyst that is catalytically effective.

The term "catalytically effective" refers to the ability of the regenerated catalyst to increase the rate of cracking reactions. The term "catalytic activity" refers to the degree to which the regenerated catalyst increases the rate of the cracking reactions and may be related to a number of catalytically active sites available on the catalyst. For example, coke deposits on the catalyst may cover up or block catalytically active sites on the spent catalyst, thus, reducing the number of catalytically active sites available, which may reduce the catalytic activity of the catalyst. Following regeneration, the regenerated catalyst may have equal to or less than 10 wt.%, 5 wt.%, or even 1 wt.% coke based on the total weight of the regenerated catalyst. In addition, the regenerator 140 may operate such that at least a portion of the sulfur that was adsorbed onto the adsorbent material is removed resulting in the adsorbent material having more active sites that can again adsorb sulfur components. The regenerated catalyst and the regenerated adsorbent material may then be recycled back to the FCC unit 130.

In one or more embodiments, the whole crude oil feed stream 102 may generally comprise whole crude oil. As used in this disclosure, the term "whole crude oil" is to be understood to mean a mixture of petroleum liquids, gases, solids, or combinations of these, including in some embodiments impurities such as sulfur-containing compounds, nitrogen-containing compounds, and metal compounds that has not undergone significant separation or reaction processes. Whole crude oil is distinguished from fractions of crude oil. In certain embodiments, the whole crude oil may be a minimally treated light crude oil to provide a crude oil feedstock having total metals (Ni+V) content of less than 10 parts per million by weight (ppmw) and Conradson carbon residue of less than 5 wt %. For example, minimal treatment may include hydroprocessing to remove, for example, heavy metals.

In one or more embodiments, the whole crude oil feed stream 102 is whole crude oil having an American Petroleum Institute (API) gravity of from 15 degrees to 50 degrees. For example, the whole crude oil feed stream 102 utilized may be an Arab heavy crude oil (API gravity of approximately 28°), Arab medium (API gravity of approximately 30°), Arab light (API gravity of approximately 33°), or Arab extra light (API gravity of approximately 39°).

In general, the contents of the whole crude oil feed stream 102 may include a relatively wide variety of chemical species based on boiling point and have characteristic of unprocessed crude oils that have not been separated into fractions. For example, the whole crude oil feed stream 102 may have a composition such that the difference between the 5 wt.% boiling point and the 95 wt.% boiling point of the whole crude oil feed stream 102 is at least 100° C., at least 200° C., at least 300° C., at least 400° C., at least 500° C., or even at least 600° C., such as from 50° C. to 1000° C., from 100° C. to 750° C., from 150° C. to 600° C., from 150° C. to 500° C., from 150° C. to 400° C., from 150° C. to 900° C., from 250° C. to 800° C., or from 350° C. to 700° C.

One or more supplemental feed streams (not shown) may be added to the whole crude oil feed stream 102 prior to introducing the whole crude oil feed stream 102 to the fluid catalytic cracking unit 130. As previously described, in one or more embodiments, the whole crude oil feed stream 102 may be whole crude oil. In one or more embodiments, the whole crude oil feed stream 102 may be whole crude oil, and one or more supplemental feed streams comprising one or more of a vacuum residue, tar sands, bitumen, atmospheric residue, vacuum gas oils, demetalized oils, naphtha streams, other hydrocarbon streams, or combinations of these materials, which may be added to the whole crude oil feed stream 102 upstream of the fluid catalytic cracking unit 130.

In one or more embodiments, the sulfur content of the whole crude oil feed stream 102 may be from 0.5 wt.% to 15 wt.%. For example, in some embodiments, the sulfur content of the whole crude oil feed stream 102 may be from 0.5 wt.% to 12.5 wt.%, from 0.5 wt.% to 10 wt.%, from 0.5 wt.% to 7.5 wt.%, from 2.5 wt.% to 15 wt.%, from 5 wt.% to 15 wt.%, from 7.5 wt.% to 15 wt.%, from 0.5 wt.% to 4.5 wt.%, from 0.5 wt.% to 4 wt.%, from 0.5 wt.% to 3.5 wt.%, from 0.5 wt.% to 3 wt.%, from 0.5 wt.% to 2.5 wt.%, from 0.5 wt.% to 2 wt.%, from 0.5 wt.% to 1.5 wt.%, from 1 wt.% to 5 wt.%, from 1.5 wt.% to 5 wt.%, from 2 wt.% to 5 wt.%, from 2.5 wt.% to 5 wt.%, from 3 wt.% to 5 wt.%, from 3.5 wt.% to 5 wt.%, from 4 wt.% to 5 wt.%, from 1 wt.% to 4 wt.%, or from 1.5 wt.% to 3.5 wt.%.

Still referring to FIG. 1, the whole crude oil feed stream 102 and the recycle catalyst and adsorbent stream 110 recycled from the regenerator 140 may enter the fluid catalytic cracking unit 130. In some embodiments, the fluid catalytic cracking unit 130 may be a riser such that the adsorbent material and cracking catalyst present in the fluid catalytic cracking unit 130 move in an upward direction during processing. The fluid catalytic cracking unit 130 may include a mixing zone 132, a cracking and adsorption zone 134, and a separation zone 136. The whole crude oil feed stream 102, adsorbent material, and/or cracking catalyst may enter the fluid catalytic cracking unit 130 in the mixing zone 132, where the whole crude oil feed stream 102, adsorbent material, and/or cracking catalyst may be allowed to thoroughly mix. The whole crude oil feed stream 102, adsorbent material, and/or cracking catalyst may then pass to the cracking and adsorption zone 134, where the whole crude oil feed stream 102, adsorbent material, and/or cracking catalyst may contact at operating conditions that result in the catalytic cracking reactions between the whole crude oil feed stream 102 and the cracking catalyst and the adsorption of sulfur from the whole crude oil feed stream 102 onto the adsorbent material. The whole crude oil feed stream 102, adsorbent material, and/or cracking catalyst may then pass to the separation zone 136, where the cracking catalyst that comprises coke deposits and the adsorbent material that has a higher concentration of adsorbed sulfur are at least partially separated from the whole crude oil feed stream 102 and the one or more formed products. The one or more formed products may be passed out of the fluid catalytic cracking unit 130 in a products stream 104. The separated adsorbent material and cracking catalyst may then be sent to the regenerator 140 in a spent catalyst and adsorbent material stream 106. It is to be understood that the adsorbent material may adsorb sulfur from the whole crude oil feed stream 102 and the cracking catalyst may catalytically react with the whole crude oil feed stream 102 while the whole crude oil feed stream 102, adsorbent material, and/or cracking catalyst are in the mixing zone 132 and separation zone 136; however, in one or more embodiments, the majority of the catalytic reactions from the cracking catalyst and sulfur adsorption by the adsorbent material is achieved in the cracking and adsorption zone 134.

According to one or more embodiments, the fluid catalytic cracking unit 130 may operate at a temperature of from 150° C. to 1000° C. For example, in some embodiments, the fluid catalytic cracking unit 130 may operate at temperatures of from 150° C. to 850° C., from 150° C. to 650° C., from 150° C. to 500° C., from 350° C. to 1000° C., from 500° C. to 1000° C., from 750° C. to 1000° C., from 350° C. to 650° C., from 400° C. to 650° C., from 450° C. to 650° C., from 500° C. to 650° C., from 550° C. to 650° C., from 300° C. to 600° C., from 300° C. to 550° C., from 300° C. to 500° C., from 300° C. to 450° C., from 350° C. to 600° C., from 400° C. to 550° C., or from 450° C. to 500° C.

The products stream 104 may include a mixture of cracked hydrocarbon materials, which may be further separated into one or more greater value petrochemical products and recovered from the system. For example, the products stream 104 may include one or more of cracked gas oil, cracked gasoline, cracked naphtha, mixed butenes, butadiene, propene, ethylene, other olefins, ethane, methane, other petrochemical products, or combinations of these. The cracked gasoline may be further processed to obtain aromatics such as benzene, toluene, xylenes, or other aromatics, for example.

In one or more embodiments, the fluid catalytic cracking unit 130 may operate such that no external hydrogen is introduced into the fluid catalytic cracking unit 130. In other words, the catalytic cracking reaction between the whole crude oil feed stream 102 and the cracking catalyst and the adsorption of sulfur from the whole crude oil feed stream 102 onto the adsorbent material may be achieved without a stream consisting essentially of hydrogen gas being introduced into the fluid catalytic cracking unit 130. It is to be understood that a small portion of hydrogen may naturally be present in the fluid catalytic cracking unit 130, but a stream consisting essentially of or majorly of hydrogen gas is not introduced into the fluid catalytic cracking unit 130. Additionally, the whole crude oil feed stream 102 and/or the adsorbent material does not need to be pretreated with hydrogen before the whole crude oil feed stream 102 and the adsorbent material enters the fluid catalytic cracking unit 130. The whole crude oil feed stream 102 and/or the adsorbent material need not be contacted with a stream consisting essentially of hydrogen gas prior to entering the fluid catalytic cracking unit 130 in order for the whole crude oil feed stream 102 and the cracking catalyst to sufficiently react and the adsorbent material to sufficiently adsorb sulfur from the whole crude oil feed stream 102 onto the adsorbent material.

In one or more embodiments, the regenerator 140 may process both the cracking catalyst and the adsorbent material by contacting each component with an oxygen-containing gas stream 108 at a regenerator temperature in order to produce a regenerated catalyst and a regenerated adsorbent material. The oxygen-containing gas may be any gas that comprises at least 0.1 mol.% oxygen, such as air. The regenerator 140 may process the catalyst by removing coke (i.e., at least a major portion of the coke) and raising the catalyst temperature (by the burning of coke for example). As described herein, the "removing" of coke from the catalyst refers to removal of at least a portion of the coke, but some residual coke may remain on the catalyst, as would be understood by those skilled in the art. The catalyst that may be recycled from the regenerator 140 to the fluid catalytic cracking unit 130 may be a regenerated catalyst, thus having a relatively high catalytic activity. The regenerator 140 may process the adsorbent material so that the adsorbent material may desorb at least a portion of the sulfur that was adsorbed onto the adsorbent material from the whole crude oil feed stream 102.

In one or more embodiments, the adsorbent material used in the hydrocarbon feed conversion system 100 may be any composition that comprises one or more silicon oxides, one or more aluminum oxides, one or more nickel oxides, and/or one or more zinc oxides. The silicon oxides may be silicon dioxide (silica), silica monoxide, or combinations thereof. The aluminum oxides may be aluminum (I) oxide, aluminum (II) oxide, aluminum (III) oxide (alumina), or combinations thereof. The nickel oxides may be nickel (II) oxide, nickel (III) oxide, or combinations thereof. The zinc oxide may have a chemical formula ZnO and be in a wurtzite crystalline form, a zincblende crystalline form, or combinations thereof. The surface of the adsorbent material may have various bondings between at least aluminum, silicon, nickel, zinc, and oxygen atoms such that one or more of Al—O, Si—O, Ni—O, and Zn—O bonds are present on the surface of the adsorbent material. It is to be understood that there are many ways of fabricating an adsorbent material that comprises one or more silicon oxides, one or more aluminum oxides, one or more nickel oxides, and/or one or more zinc oxides, and these various methods are contemplated in this application.

Without being bound by a particular theory, it is believed that when the adsorbent material contacts the whole crude oil feed stream 102 that comprises sulfur while in the fluid catalytic cracking unit 130, the sulfur of the whole crude oil feed stream 102 will react with at least a portion of the Zn—O and Ni—O bonds present on the surface of the adsorbent material such that at least a portion of the oxygen atoms are removed and replaced with sulfur atoms such that new Zn—S and Ni—S bonds are present on the surface of the adsorbent material, thus adsorbing at least a portion of the sulfur from the whole crude oil feed stream 102. When the spent adsorbent material, meaning the adsorbent material that has adsorbed at least a portion of the sulfur from the whole crude oil feed stream 102, is sent to the regenerator 140 and contacted with the oxygen-containing gas, at least a portion of the Zn—S and Ni—S bonds present on the surface of the spent adsorbent material will react with the oxygen in the oxygen-containing gas, which removes at least a portion of the sulfur adsorbed onto the adsorbent material and replaces at least a portion of the sulfur with oxygen to increase the amount of Zn—O and Ni—O bonds present on the surface of the regenerated adsorbent material.

The regenerator 140 may operate at a regenerator temperature of from 350° C. to 1500° C. For example, in one or more embodiments, the regenerator 140 may operate at a regenerator temperature of from 350° C. to 1250° C., from 350° C. to 1000° C., from 350° C. to 750° C., from 500° C. to 1500° C., from 750° C. to 1500° C., from 1000° C. to 1500° C., from 600° C. to 850° C., from 650° C. to 850° C., from 700° C. to 850° C., from 550° C. to 850° C., from 750° C. to 850° C., from 550° C. to 800° C., from 550° C. to 750° C., from 550° C. to 700° C., from 550° C. to 650° C., or from 650° C. to 750° C.

In one or more embodiments, the adsorbent material comprises from 1 wt.% to 50 wt.% of the one or more nickel oxides relative to the total weight of the adsorbent material. For example, in some embodiments, the adsorbent material comprises from 1.5 wt.% to 50 wt.%, from 2 wt.% to 50 wt.%, from 2.5 wt.% to 50 wt.%, from 3 wt.% to 50 wt.%, from 3.5 wt.% to 50 wt.%, from 4 wt.% to 50 wt.%, from 4.5 wt.% to 50 wt.%, from 5 wt.% to 50 wt.%, from 10 wt.% to 50 wt.%, from 15 wt.% to 50 wt.%, from 20 wt.% to 50 wt.%, from 25 wt.% to 50 wt.%, from 1 wt.% to 40 wt.%, from 1 wt.% to 30 wt.%, from 1 wt.% to 20 wt.%, from 1 wt.% to 10 wt.%, from 1 wt.% to 7.5 wt.%, from 1 wt.% to 5 wt.%, from 1 wt.% to 4.5 wt.%, from 1 wt.% to 4 wt.%, from 1 wt.% to 3.5 wt.%, from 1 wt.% to 3 wt.%, from 1 wt.% to 2.5 wt.%, from 1 wt.% to 2 wt.%, from 2 wt.% to 40 wt.%, from 2.5 wt.% to 25 wt.%, or from 5 wt.% to 20 wt.% of the one or more nickel oxides relative to the total weight of the adsorbent material.

In one or more embodiments, the adsorbent material comprises from 1 wt.% to 50 wt.% of the one or more zinc oxides relative to the total weight of the adsorbent material. For example, in some embodiments, the adsorbent material comprises from 1.5 wt.% to 50 wt.%, from 2 wt.% to 50 wt.%, from 2.5 wt.% to 50 wt.%, from 3 wt.% to 50 wt.%, from 3.5 wt.% to 50 wt.%, from 4 wt.% to 50 wt.%, from 4.5 wt.% to 50 wt.%, from 5 wt.% to 50 wt.%, from 10 wt.% to 50 wt.%, from 15 wt.% to 50 wt.%, from 20 wt.% to 50 wt.%, from 25 wt.% to 50 wt.%, from 1 wt.% to 40 wt.%, from 1 wt.% to 30 wt.%, from 1 wt.% to 20 wt.%, from 1 wt.% to 10 wt.%, from 1 wt.% to 7.5 wt.%, from 1 wt.% to 5 wt.%, from 1 wt.% to 4.5 wt.%, from 1 wt.% to 4 wt.%, from 1 wt.% to 3.5 wt.%, from 1 wt.% to 3 wt.%, from 1 wt.% to 2.5 wt.%, from 1 wt.% to 2 wt.%, from 2 wt.% to 40 wt.%, from 2.5 wt.% to 25 wt.%, or from 5 wt.% to 20 wt.% of the one or more zinc oxides relative to the total weight of the adsorbent material.

In one or more embodiments, the adsorbent material comprises from 8 wt.% to 12 wt.% of the one or more nickel oxides, from 18 wt.% to 22 wt.% of the one or more zinc oxides, and from 65 wt.% to 70 wt.% of the one or more aluminum oxides relative to the total weight of the adsorbent material. In one or more embodiments, the adsorbent material comprises 10 wt.% of the one or more nickel oxides, 21.4 wt.% of the one or more zinc oxides, and 68.6 wt.% of the one or more aluminum oxides relative to the total weight of the adsorbent material.

The catalyst used in the hydrocarbon feed conversion system 100 may include one or more fluid catalytic cracking catalysts that are suitable for use in the fluid catalytic cracking unit 130. The catalyst may be a heat carrier and may provide heat transfer to the fluid catalytic cracking unit 130. The catalyst may also have a plurality of catalytically active sites, such as acidic sites for example, that promote the cracking reaction. For example, in embodiments, the catalyst may be a high-activity FCC catalyst having high catalytic activity. Examples of fluid catalytic cracking catalysts suitable for use in the hydrocarbon feed conversion system 100 may include, without limitation, zeolites, silica-alumina catalysts, carbon monoxide burning promoter additives, bottoms cracking additives, light olefin-producing additives, other catalyst additives, or combinations of these components. Zeolites that may be used as at least a portion of the catalyst for cracking may include, but are not limited to Y, REY, USY, RE-USY zeolites, or combinations of these.

The catalyst may also include a shaped selective catalyst additive, such as ZSM-5 zeolite crystals or other pentasil-type catalyst structures, which are often used in other FCC processes to produce light olefins and/or increase FCC gasoline octane. In one or more embodiments, the catalyst may include a mixture of a ZSM-5 zeolite crystals and the cracking catalyst zeolite and matrix structure of a typical FCC cracking catalyst. In one or more embodiments, the catalyst may be a mixture of Y and ZSM-5 zeolite catalysts embedded with clay, alumina, and binder.

In one or more embodiments, at least a portion of the catalyst may be modified to include one or more rare earth elements (15 elements of the Lanthanide series of the IUPAC Periodic Table plus scandium and yttrium), alkaline earth metals (Group 2 of the IUPAC Periodic Table), transition metals, phosphorus, fluorine, or any combination of these, which may enhance olefin yield in the fluid catalytic cracking unit 130. Transition metals may include "an element whose atom has a partially filled d sub-shell, or which can give rise to cations with an incomplete d sub-shell" [IUPAC, Compendium of Chemical Terminology, 2nd ed. (the "Gold Book") (1997). Online corrected version: (2006-) "transition element"]. One or more transition metals or metal oxides may also be impregnated onto the catalyst. Metals or metal oxides may include one or more metals from Groups 6-10 of the IUPAC Periodic Table. In some embodiments, the metals or metal oxides may include one or more of molybdenum, rhenium, tungsten, or any combination of these. In one or more embodiments, a portion of the catalyst may be impregnated with tungsten oxide.

EXAMPLES

Examples are provided herein which may disclose one or more embodiments of the present disclosure. However, the Examples should not be viewed as limiting on the claimed embodiments hereinafter provided.

Example 1—Desulfurization Testing of Adsorbent Materials

Multiple adsorbent materials were formed and then tested in a fixed bed continuous flow reactor. One adsorbent material (calcined $NiZn/Al_2O_3$) was synthesized from nickel, zinc, and aluminum oxides, where the adsorbent material contained from 1 wt.% to 50 wt.% of nickel oxide when compared to the total weight of the adsorbent material and the adsorbent material contained from 1 wt.% to 50 wt.% of zinc oxide when compared to the total weight of the adsorbent material. Another adsorbent material ($Ni/Al_2O_3$) was synthesized from just nickel and aluminum oxides. Both adsorbent materials were evaluated by contacting model oil (2 wt.% thiophene in hexane with a 20,000 ppm sulfur concentration) in the fixed bed continuous flow reactor, where the sulfur content was then analyzed using an ANTEK Nitrogen and Sulfur Analyzer. The reaction conditions include a temperature of 500° C., ambient pressure, 1 mL/min of the 2 wt.% thiophene in hexane, 0.77 g of adsorbent material, an oil to adsorbent material weight hour space velocity (WHSV) of 500 $hr^{-1}$, and a ratio of oil to adsorbent material of about 7. The conversion was calculated using Equation 1 below, where $S_{in}$ is the sulfur content before entering the reactor and $S_{out}$ is the sulfur content after exiting the reactor:

$$\text{Conversion} = \frac{Sin - Sout}{Sin} * 100\% \quad \text{(Equation 1)}$$

Below in Table 1 is the percent conversion of sulfur that each adsorbent material achieved. It is important to note that the calcined $NiZn/Al_2O_3$ adsorbent material achieved a much higher conversion when compared to the $Ni/Al_2O_3$ adsorbent material.

TABLE 1

Desulfurization Conversion of Tested Adsorbent Materials

| Adsorbent Material | Desulfurization Conversion |
|---|---|
| $Ni/Al_2O_3$ Adsorbent Material | 7% |
| Calcined $NiZn/Al_2O_3$ Adsorbent Material | 33% |

Example 2—Regeneration Testing of Adsorbent Materials

The calcined $NiZn/Al_2O_3$ adsorbent material and the $Ni/Al_2O_3$ adsorbent material were then tested under regeneration conditions including contacting the adsorbent materials with air at a temperature of about 700° C. for about 10 minutes after going through the testing of Example 1. The adsorbent materials were then cycled through the testing of Example 1 again. The calcined $NiZn/Al_2O_3$ adsorbent material did not demonstrate any signs of damage and was able to achieve a similar desulfurization conversion and olefin product production as achieved during the first cycle. Conversely, the $Ni/Al_2O_3$ adsorbent material did demonstrate signs of damage and achieved significantly less desulfurization conversion and olefin product production when compared to the first cycle.

The present disclosure includes one or more non-limiting aspects. A first aspect includes a method of processing a whole crude oil feed stream, the method comprising: passing a whole crude oil feed stream into a fluid catalytic cracking unit and contacting the whole crude oil feed stream with an adsorbent material and a cracking catalyst in the fluid catalytic cracking unit, wherein the cracking catalyst comprises zeolite, wherein the whole crude oil feed stream comprises sulfur, and wherein in the fluid catalytic cracking unit: the adsorbent material adsorbs at least a portion of the sulfur of the whole crude oil feed stream such that the content of sulfur on the adsorbent material increases; and at least a portion of the whole crude oil feed stream is catalytically cracked to produce one or more products and coke disposed on the cracking catalyst; and passing the adsorbent material and the cracking catalyst comprising coke to a regenerator, wherein the adsorbent material and the cracking catalyst contact an oxygen-containing gas at a regenerator temperature sufficient to remove at least a portion of the sulfur on the adsorbent material and combust at least a portion of the coke on the catalyst; and passing the adsorbent material and the cracking catalyst from the regenerator to the fluid catalytic cracking unit.

A second aspect includes any above aspect, wherein the adsorbent material and the cracking catalyst are mixed in the fluid catalytic cracking unit.

A third aspect includes any above aspect, wherein the regenerator temperature is from 550° C. to 850° C.

A fourth aspect includes any above aspect, wherein the regenerator temperature is from 650° C. to 750° C.

A fifth aspect includes any above aspect, wherein the adsorbent material and the cracking catalyst are mixed in the regenerator.

A sixth aspect includes any above aspect, wherein no external hydrogen is introduced into the fluid catalytic cracking unit.

A seventh aspect includes any above aspect, wherein the whole crude oil feed stream is not pretreated with hydrogen before entering the fluid catalytic cracking unit; and the adsorbent material is not pretreated with hydrogen before entering the fluid catalytic cracking unit.

An eighth aspect includes any above aspect, wherein the adsorbent material comprises one or more aluminum oxides, one or more nickel oxides, and one or more zinc oxides.

A ninth aspect includes any above aspect, wherein the adsorbent material comprises from 1 wt.% to 50 wt.% of the one or more nickel oxides relative to the total weight of the adsorbent material.

A tenth aspect includes any above aspect, wherein the adsorbent material comprises from 1 wt.% to 50 wt.% of the one or more zinc oxides relative to the total weight of the adsorbent material.

An eleventh aspect includes any above aspect, wherein the adsorbent material comprises 10 wt.% of the one or more nickel oxides, 21.4 wt.% of the one or more zinc oxides, and 68.6 wt.% of the one or more aluminum oxides relative to the total weight of the adsorbent material.

A twelfth aspect includes any above aspect, wherein the sulfur content of the whole crude oil feed stream is from 0.5 wt.% to 5 wt.%.

A thirteenth aspect includes any above aspect, wherein the one or more products comprise olefins, aromatics, or combination of these.

A fourteenth aspect includes any above aspect, wherein the fluid catalytic cracking unit operates at a temperature of from 300° C. to 650° C.

A fifteenth aspect includes any above aspect, wherein the fluid catalytic cracking unit operates at a temperature of from 450° C. to 550° C.

A sixteenth aspect includes any above aspect, wherein the whole crude oil feed stream comprises crude oil having an American Petroleum Institute (API) gravity of from 15 degrees to 50 degrees.

A seventeenth aspect includes any above aspect, wherein the whole crude oil feed stream comprises Arab Heavy crude oil, Arab Medium crude oil, Arab Light crude oil, or Arab Extra Light crude oil.

An eighteenth aspect includes any above aspect, wherein the adsorbent material and the cracking catalyst are fluidized in the fluid catalytic cracking unit.

A nineteenth aspect includes any above aspect, wherein the cracking catalyst and the adsorbent material are present in the fluid catalytic cracking unit at a weight ratio of from 95:5 to 80:20 of the cracking catalyst to the adsorbent material.

A twentieth aspect includes any above aspect, wherein: the adsorbent material comprises one or more aluminum oxides, one or more nickel oxides, and one or more zinc oxides; the adsorbent material comprises from 1 wt.% to 50 wt.% of the one or more nickel oxides relative to the total weight of the adsorbent material; the adsorbent material comprises from 1 wt.% to 50 wt.% of the one or more zinc oxides relative to the total weight of the adsorbent material; the whole crude oil feed stream comprises crude oil having an American Petroleum Institute (API) gravity of from 15 degrees to 50 degrees; and the sulfur content of the whole crude oil feed stream is from 0.5 wt.% to 5 wt.%.

The subject matter of the present disclosure has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

It is noted that one or more of the following claims utilize the term "wherein" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that where a first component is described as "comprising" a second component, it is contemplated that, in some embodiments, the first component "consists" or "consists essentially of" that second component. It should further be understood that where a first component is described as "comprising" a second component, it is contemplated that, in some embodiments, the first component comprises at least 10%, at least 20%, at least 30%, at least 40%, at least 50%, at least 60%, at least 70%, at least 80%, at least 90%, at least 95%, or even at least 99% that second component (where % can be weight % or molar %).

For the purposes of describing and defining the present inventive technology, it is noted that reference herein to a variable being a "function" of a parameter or another variable is not intended to denote that the variable is exclusively a function of the listed parameter or variable. Rather, reference herein to a variable that is a "function" of a listed parameter is intended to be open ended such that the variable may be a function of a single parameter or a plurality of parameters.

It is also noted that recitations herein of "at least one" component, element, etc., should not be used to create an inference that the alternative use of the articles "a" or "an" should be limited to a single component, element, etc.

It should be understood that any two quantitative values assigned to a property may constitute a range of that property, and all combinations of ranges formed from all stated quantitative values of a given property are contemplated herein.

What is claimed is:

1. A method of processing a whole crude oil feed stream, the method comprising:

passing a whole crude oil feed stream into a fluid catalytic cracking unit and contacting the whole crude oil feed stream with an adsorbent material and a cracking catalyst in the fluid catalytic cracking unit, wherein the cracking catalyst comprises zeolite, wherein the whole crude oil feed stream comprises sulfur, and wherein in the fluid catalytic cracking unit:

the adsorbent material adsorbs at least a portion of the sulfur of the whole crude oil feed stream such that the content of sulfur on the adsorbent material increases; and at least a portion of the whole crude oil feed stream is catalytically cracked to produce one or more products and coke disposed on the cracking catalyst; and passing the adsorbent material and the cracking catalyst comprising coke to a regenerator, wherein the adsorbent material and the cracking catalyst contact an oxygen-containing gas at a regenerator temperature sufficient to remove at least a portion of the sulfur on the adsorbent material and combust at least a portion of the coke on the catalyst; and passing the adsorbent material and the cracking catalyst from the regenerator to the fluid catalytic cracking unit;

wherein the adsorbent material and the cracking catalyst are mixed in the regenerator and are regenerated while mixed.

2. The method of claim 1, wherein the adsorbent material and the cracking catalyst are mixed in the fluid catalytic cracking unit.

3. The method of claim 1, wherein the regenerator temperature is from 550° C. to 850° C.

4. The method of claim 1, wherein the regenerator temperature is from 650° C. to 750° C.

5. The method of claim 1, wherein no external hydrogen is introduced into the fluid catalytic cracking unit.

6. The method of claim 1, wherein:

the whole crude oil feed stream is not pretreated with hydrogen before entering the fluid catalytic cracking unit; and the adsorbent material is not pretreated with hydrogen before entering the fluid catalytic cracking unit.

7. The method of claim 1, wherein the adsorbent material comprises one or more aluminum oxides, one or more nickel oxides, and one or more zinc oxides.

8. The method of claim 7, wherein the adsorbent material comprises from 1 wt.% to 50 wt.% of the one or more nickel oxides relative to the total weight of the adsorbent material.

9. The method of claim 7, wherein the adsorbent material comprises from 1 wt.% to 50 wt.% of the one or more zinc oxides relative to the total weight of the adsorbent material.

10. The method of claim 7, wherein the adsorbent material comprises 10 wt.% of the one or more nickel oxides, 21.4 wt.% of the one or more zinc oxides, and 68.6 wt.% of the one or more aluminum oxides relative to the total weight of the adsorbent material.

11. The method of claim 1, wherein the sulfur content of the whole crude oil feed stream is from 0.5 wt.% to 5 wt.%.

12. The method of claim 1, wherein the one or more products comprise olefins, aromatics, or combination of these.

13. The method of claim 1, wherein the fluid catalytic cracking unit operates at a temperature of from 300° C. to 650° C.

14. The method of claim 1, wherein the fluid catalytic cracking unit operates at a temperature of from 450° C. to 550° C.

15. The method of claim 1, wherein the whole crude oil feed stream comprises crude oil having an American Petroleum Institute (API) gravity of from 15 degrees to 50 degrees.

16. The method of claim 1, wherein the whole crude oil feed stream comprises one or more crude oils selected from the group consisting of Arab Heavy crude oil, Arab Medium crude oil, Arab Light crude oil, or Arab Extra Light crude oil.

17. The method of claim 1, wherein the adsorbent material and the cracking catalyst are fluidized in the fluid catalytic cracking unit.

18. The method of claim 1, wherein the cracking catalyst and the adsorbent material are present in the fluid catalytic cracking unit at a weight ratio of from 95:5 to 80:20 of the cracking catalyst to the adsorbent material.

19. The method of claim 1, wherein:

the adsorbent material comprises one or more aluminum oxides, one or more nickel oxides, and one or more zinc oxides;

the adsorbent material comprises from 1 wt.% to 50 wt.% of the one or more nickel oxides relative to the total weight of the adsorbent material;

the adsorbent material comprises from 1 wt.% to 50 wt.% of the one or more zinc oxides relative to the total weight of the adsorbent material;

the whole crude oil feed stream comprises crude oil having an American Petroleum Institute (API) gravity of from 15 degrees to 50 degrees; and the sulfur content of the whole crude oil feed stream is from 0.5 wt.% to 5 wt.%.

20. A method of processing a whole crude oil feed stream, the method comprising:

passing a whole crude oil feed stream into a fluid catalytic cracking unit and contacting the whole crude oil feed stream with an adsorbent material and a cracking catalyst in the fluid catalytic cracking unit, wherein the cracking catalyst comprises zeolite, wherein the whole crude oil feed stream comprises sulfur, and wherein in the fluid catalytic cracking unit:

the adsorbent material adsorbs at least a portion of the sulfur of the whole crude oil feed stream such that the content of sulfur on the adsorbent material increases; and at least a portion of the whole crude oil feed stream is catalytically cracked to produce one or more products and coke disposed on the cracking catalyst; and passing the adsorbent material and the cracking catalyst comprising coke to a regenerator, wherein the adsorbent material and the cracking catalyst contact an oxygen-containing gas at a regenerator temperature sufficient to remove at least a portion of the sulfur on the adsorbent material and combust at least a portion of the coke on the catalyst; and passing the adsorbent material and the cracking catalyst from the regenerator to the fluid catalytic cracking unit;

wherein the adsorbent material comprises one or more aluminum oxides, one or more nickel oxides, and one or more zinc oxides.

* * * * *